US009217981B2

(12) United States Patent
Kimoto et al.

(10) Patent No.: US 9,217,981 B2
(45) Date of Patent: Dec. 22, 2015

(54) POSITIVELY-CHARGED SINGLE-LAYER ELECTROPHOTOGRAPHIC PHOTORECEPTOR AND IMAGE FORMING APPARATUS

(71) Applicant: KYOCERA Document Solutions Inc., Osaka-shi, Osaka (JP)

(72) Inventors: Keizo Kimoto, Osaka (JP); Sakae Saito, Osaka (JP); Yasufumi Mizuta, Osaka (JP); Kazunari Hamasaki, Osaka (JP); Syoji Itsumi, Osaka (JP); Hiroshi Takemoto, Osaka (JP)

(73) Assignee: KYOCERA Document Solutions Inc. (JP)

( * ) Notice: Subject to any disclaimer, the term of this patent is extended or adjusted under 35 U.S.C. 154(b) by 64 days.

(21) Appl. No.: 14/036,067

(22) Filed: Sep. 25, 2013

(65) Prior Publication Data

US 2014/0093280 A1 Apr. 3, 2014

(30) Foreign Application Priority Data

Sep. 28, 2012 (JP) ..... 2012-218012

(51) Int. Cl.

| | |
|---|---|
| ***G03G 15/00*** | (2006.01) |
| ***G03G 5/04*** | (2006.01) |
| ***G03G 5/043*** | (2006.01) |
| ***G03G 5/10*** | (2006.01) |

(52) U.S. Cl.

CPC ..... *G03G 15/751* (2013.01); *G03G 5/04* (2013.01); *G03G 5/043* (2013.01); *G03G 5/10* (2013.01); *G03G 5/102* (2013.01)

(58) Field of Classification Search

CPC ..... G03G 15/162; G03G 15/751; G03G 5/10; G03G 5/102; G03G 7/006; G03G 7/0073; G03G 7/0093

See application file for complete search history.

(56) References Cited

U.S. PATENT DOCUMENTS

| | | | | |
|---|---|---|---|---|
| 5,432,038 | A | 7/1995 | Kaatsukawa et al. | |
| 5,587,266 | A * | 12/1996 | Ujihara et al. | 430/133 |
| 6,438,339 | B1 * | 8/2002 | Kaiho | 399/92 |

(Continued)

FOREIGN PATENT DOCUMENTS

| | | |
|---|---|---|
| JP | Sho 61-110147 | 5/1986 |
| JP | 63-77060 | 4/1988 |

(Continued)

OTHER PUBLICATIONS

Summary of Office Action Issued in Japanese Patent Application No. 2012-218012—Aug. 4, 2014.

(Continued)

*Primary Examiner* — David Gray
*Assistant Examiner* — Carla Therrien
(74) *Attorney, Agent, or Firm* — Gerald E. Hespos; Michael J. Porco; Matthew T. Hespos

(57) ABSTRACT

Disclosed is a positively-charged electrophotographic photoreceptor which uses a tubular photosensitive layer support base with a wall thickness of (t), wherein (t) is 0.7 mm or less, a chamfer angle (a) of an end surface of the photosensitive layer support base is 30° or more and 60° or less with respect to a longitudinal tangent of a surface of a tubular photosensitive layer support base, and an outer end surface-tail edge surface width (b) of the tubular photosensitive layer support base is 0.05 mm or more.

6 Claims, 3 Drawing Sheets

(56) References Cited

U.S. PATENT DOCUMENTS

| | | | | |
|---|---|---|---|---|
| 7,897,315 | B2 * | 3/2011 | Takemoto et al. | 430/69 |
| 8,295,732 | B2 * | 10/2012 | Nakano | 399/159 |
| 2008/0003016 | A1 * | 1/2008 | Nakano | 399/159 |
| 2010/0323288 | A1 | 12/2010 | Altavela et al. | |

FOREIGN PATENT DOCUMENTS

| | | |
|---|---|---|
| JP | 6-222576 | 8/1994 |
| JP | 7-155683 | 6/1995 |
| JP | 8-95265 | 4/1996 |
| JP | 2001-175008 | 6/2001 |
| JP | 2006-47716 | 2/2006 |
| JP | 2007-171271 | 7/2007 |
| JP | 2009-003478 | 1/2009 |

OTHER PUBLICATIONS

Summary of Office Action issued in Korean Patent Application No. 10-2013-0113847—Sep. 19, 2014.

Korean Patent Appl. No. 10-2013-00113847—Korean Office Action issued on Feb. 12, 2015.

* cited by examiner

POSITIVELY-CHARGED SINGLE-LAYER ELECTROPHOTOGRAPHIC PHOTORECEPTOR AND IMAGE FORMING APPARATUS

BACKGROUND

This application is based on, and claims priority from, Japanese Patent Application No. 2012-218012, filed on Sep. 28, 2012 with the Japan Patent Office, the entire contents of which are incorporated herein by reference.

The present disclosure relates to a positively-charged single-layer electrophotographic photoreceptor and an image forming apparatus comprising the positively-charged single-layer electrophotographic photoreceptor as an image carrier.

Conventionally, organic photo conductors (OPCs) are widely used as photoreceptors in image forming apparatuses. Organic photo conductors can be roughly divided into single-layer organic photo conductors in which a single layer created by dispersing a charge generating material (CGM) and a charge transporting material (CTM) in a binder resin is formed on a tubular photosensitive layer support base made of aluminum or the like, and organic photo conductors in which a layer containing a CGM and a layer containing a CTM are laminated on a tubular photosensitive layer support base.

Among organic photo conductors, single-layer organic photo conductors have a simple layer construction and therefore offer superior productivity. In addition, when such a single-layer organic photo conductor is combined with a charging member which adopts a contact-charging system and used as a positively-charged single-layer organic photoreceptor, oxidized gas such as ozone which adversely affects office environment is hardly generated.

Therefore, due to such advantages, positively-charged single-layer electrophotographic photoreceptors are becoming more utilized.

An electrophotographic photoreceptor is manufactured by applying the photosensitive material on a circumferential surface of a photoreceptor support base.

In addition, an application method thereof usually involves moving a container (a coating tank) that houses an application liquid of the photoreceptor material and the support base relative to each other, dipping the support base in the application liquid, and pulling the support base out from the container at a predetermined speed.

According to the adopted method, the extracted photoreceptor support base is next immobilized and dried naturally, and subsequently placed in an oven or the like to be completely dried. Since an electrophotographic photoreceptor having a photosensitive coating film with a uniform thickness is manufactured in a short period time, a quick-drying solvent is usually used as a solvent of the application liquid.

When using a quick-drying solvent, although a drying rate of the application liquid can be increased and the application liquid can be solidified in a short period time, since heat loss occurs after dipping at the coating film and the support base due to heat of vaporization as the solvent evaporates between the extraction and set to touch, an abrupt temperature drop occurs and the temperature of the coating film falls to or below dew point. When the temperature of the coating film drops to or below dew point, due to condensation of water vapor in the air, the coating film takes in moisture and causes the surface of the coating film to turn white (a blushing phenomenon). Whitening of the surface of the coating film as described above is not only unfavorable in terms of appearance but is also problematic in that the whitening significantly affects charging characteristics and abrasion resistance of the electrophotographic photoreceptor and lead to a fatal defect.

Although characteristics of laminated organic photo conductors are also affected by blushing, the impact on single-layer organic photo conductors is more prominent since the charge generating material exists on the surface of the photo conductor. As a result, an inconvenience in that various characteristics of the photo conductor such as repetition characteristics during continuous use, ozone resistance and abrasion resistance decline become pronounced.

In consideration of such circumstances, there are demands for suppressing blushing that occurs during production of positively-charged single-layer electrophotographic photoreceptors. Conventionally, a method of preventing the occurrence of blushing has involved bringing a holding member that is used during coating into contact with an inner surface of a support base and adjusting a length and material of the holding member to control a temperature of the support base. However, this method is not sufficient. Furthermore, while attempts have been made involving heating a support base during drying of a coating film (JP Patent Publication 63-77060), managing temperature of an application liquid (JP Patent Publication 6-222576), managing a difference in temperature between a coating atmosphere and an application liquid (JP Patent Publication 7-155683), and controlling humidity of a coating atmosphere (JP Patent Publication 8-95265), applying these methods require investment in facilities.

In contrast, as a method of preventing blushing without the use of specialized equipment, a method is proposed in which a solvent used, density, specific heat, and thickness of support base material, and thickness of a formed photosensitive layer are controlled so as to satisfy specific conditions (JP Patent Publication 2001-175008).

In recent years, from the perspectives of downsizing, cost reduction, reduction in power consumption, and the like of electrophotographic apparatuses, reductions in size and weight of electrophotographic photoreceptors are desired. In addition, reductions in material cost and necessary drive power with respect to photosensitive layer support bases by further weight reduction are also desired. While a reduction in weight of a support base can be readily achieved by reducing wall thickness of the support base, this also causes a decline in heat capacity of the support base itself. Since a decline in heat capacity of the support base makes it easier for heat of vaporization due to evaporation of a solvent during coating of a photosensitive layer to cool the support base down to or below dew point, blushing is likely to occur.

Therefore, when a thin-walled support base is used, depending on a method of controlling a solvent used, density, specific heat, and thickness of support base material, and thickness of a formed photosensitive layer so as to satisfy specific conditions as described in JP Patent Publication 2001-175008, the occurrence of blushing cannot be prevented.

In addition, when the support base is coated with an application liquid for forming a photosensitive layer, a coating film at an end of the support base bulges due to the effect of surface tension and is likely to lose more heat of vaporization. Therefore, with an electrophotographic photoreceptor using a thin-walled support base, blushing is more likely to occur at the end. When forming a photosensitive layer by an immersion-removal method, since the effect of gravity comes into play in addition to the effect of surface tension, the coating film at a lower end of the support base is likely to become thicker. As a result, particularly at the lower end of the photoreceptor, blushing tends to occur prominently.

The present disclosure has been made in consideration of the circumstances described above, and an object thereof is to provide a positively-charged single-layer electrophotographic photoreceptor which comprises a blushing-free photosensitive layer on a thin-walled support base.

The present inventors have found that the occurrence of blushing can be prevented with a positively-charged photoreceptor that uses a tubular photosensitive layer support base with a wall thickness of 0.7 mm or less by having a cross-sectional shape of a support base end surface satisfy specific conditions in order to reduce a liquid sump that occurs in a lower portion of a tubular photosensitive layer support base when the tubular photosensitive layer support base is pulled out of a coating tank during coating. The present disclosure is based on these findings. More specifically, the present disclosure provides the following.

SUMMARY

An aspect of the present disclosure is a positively-charged single-layer electrophotographic photoreceptor which uses a tubular photosensitive layer support base with a wall thickness of (t), wherein (t) is 0.7 mm or less, a chamfer angle (a) of an end surface of the photosensitive layer support base is 30° or more and 60° or less with respect to a longitudinal tangent of a surface of a tubular photosensitive layer support base, and an outer end surface-tail edge surface width (b) of the tubular photosensitive layer support base is 0.05 mm or more.

DETAILED DESCRIPTION

Figure 1:
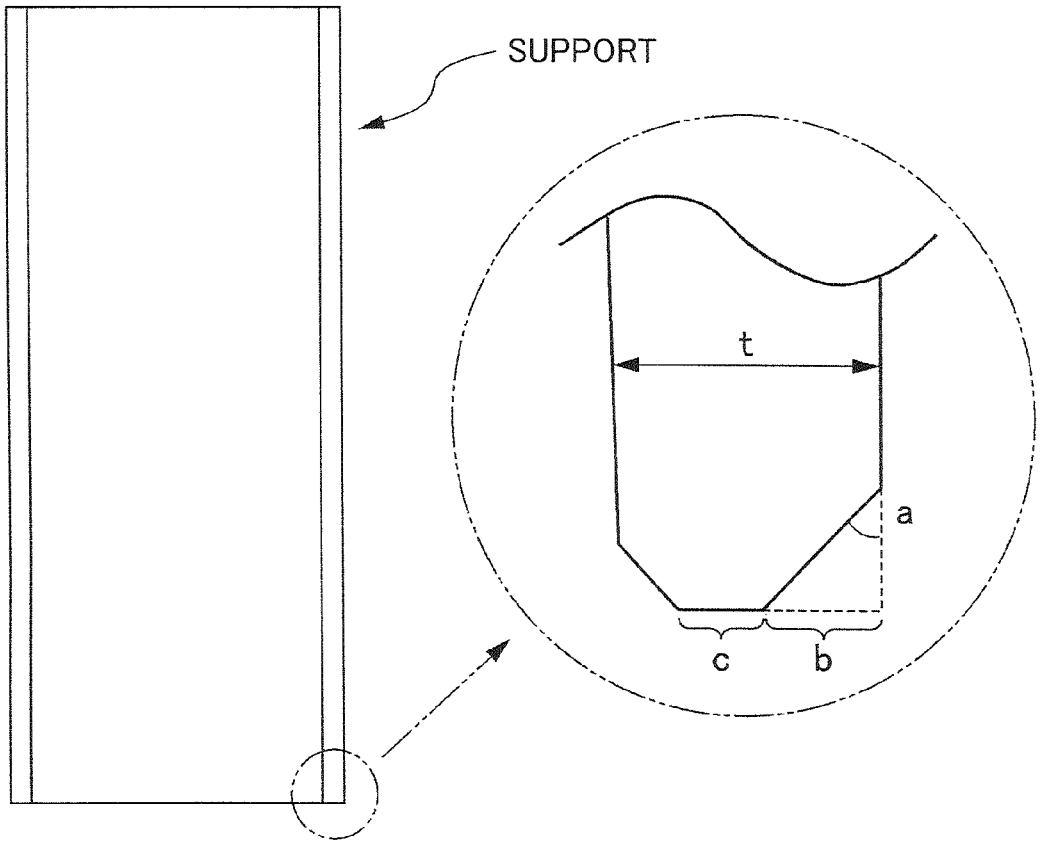
FIG. 1 is a diagram schematically showing a cross section of a photosensitive layer support base according to the present disclosure and the end shape thereof.

Hereinafter, embodiments of the present disclosure will be described. However, the present disclosure is not limited to these embodiments.

First Embodiment

A first embodiment of the present disclosure relates to a positively-charged single-layer electrophotographic photoreceptor. A positively-charged single-layer electrophotographic photoreceptor according to the present embodiment comprises a photosensitive layer support base and a single-layer photosensitive layer which is formed using a photosensitive layer application liquid containing a specific solvent on the photosensitive layer support base and which contains a charge generating material, a charge transporting material, and a binding resin. In this case, the positively-charged single-layer electrophotographic photoreceptor is not particularly limited as long as the positively-charged single-layer electrophotographic photoreceptor comprises the photosensitive layer support base and the photosensitive layer. Specifically, for example, the photosensitive layer may be directly provided on the photosensitive layer support base or an intermediate layer may be provided between the photosensitive layer support base and the photosensitive layer. Alternatively, the photosensitive layer may be exposed as an outermost layer or a protective layer may be provided on the photosensitive layer.

According to the present embodiment, a positively-charged single-layer electrophotographic photoreceptor comprising a blushing-free photosensitive layer on a thin-walled support base can be provided.

Hereinafter, the photosensitive layer support base and the photosensitive layer will be described in this order.

[Photosensitive Layer Support Base]

The photosensitive layer support base (hereinafter, also referred to as a tubular photosensitive layer support base) used in the present embodiment is not particularly limited as long as the photosensitive layer support base can be normally used as a photosensitive layer support base of a positively-charged single-layer electrophotographic photoreceptor. Specifically, for example, at least a surface portion of the photosensitive layer support base is constituted by a conductive material. Specific examples include a photosensitive layer support base made of a conductive material or a photosensitive layer support base in which a surface of a plastic material or the like is covered by a conductive material. In addition, examples of conductive materials include aluminum, iron, copper, tin, platinum, silver, vanadium, molybdenum, chromium, cadmium, titanium, nickel, palladium, indium, stainless steel, and brass. Furthermore, as the conductive material, a conductive material may be used alone or two or more conductive materials may be combined and used as an alloy or the like. Among the above, the photosensitive layer support base is favorably made of aluminum or an aluminum alloy. Accordingly, a positively-charged single-layer electrophotographic photoreceptor capable of forming more preferable images can be provided. This is conceivably due to the fact that charges move from the photosensitive layer to the photosensitive layer support base in a preferable manner.

A wall thickness (t) of the photosensitive layer support base according to the present embodiment is 0.7 mm or less, and further favorably 0.60 mm or less from the perspective of reducing weight of a photosensitive drum. With a reduction in heat capacity due to thinner walls, the photosensitive layer support base cools down more readily. Therefore, from the perspective of preventing blushing and also from the perspective of mechanical strength, the wall thickness of the photosensitive layer support base is favorably 0.4 mm or more and more favorably 0.5 mm or more.

The photosensitive layer support base according to the present embodiment is tubular and, as shown in FIG. 1, chamfering of a surface side of the support base end surface is performed so that an angle (a) with respect to a longitudinal direction of the tubular photosensitive layer support base surface is 30° or more and 60° or less, and a distance between a tangential line in the longitudinal direction of the tubular photosensitive layer support base surface and a bottom end of an end surface of the tubular photosensitive layer support base (outer end surface-tail edge surface width) (b) is 0.05 mm or more. Moreover, in FIG. 1, in order to prevent an application liquid from pooling on an inner side of the support base end surface, the inner side of the support base end surface is desirably chamfered.

As a result of intensive studies carried out in order to prevent blushing of a photosensitive layer which is a problem when using a thin-walled support base, the present inventors have found that shaping the support base end surface so as to satisfy the conditions described above enables an increase in thickness of a coating film of the support base end to be suppressed when coating is performed using a dip coater or the like (to be described later). A thinner coating film of the support base end prevents rapid cooling of the tubular photosensitive layer support base due to evaporation of the solvent at the support base end. Therefore, it is conceivable that the temperature of the tubular photosensitive layer support base does not drop below dew point and that an occurrence of blushing can be prevented.

Furthermore, favorably, from the perspective of mechanical strength, a bottom surface length (c) of the photosensitive layer support base according to the photosensitive layer support base is 0.3 mm or more and less than (t) (where (t) denotes the wall thickness of the photosensitive layer support base as described earlier). A bottom surface length (c) of less than 0.3 mm is unfavorable because defects such as deformation of a tip occur when a shock is applied to the end during manufacture or use of the photoreceptor.

Although a diameter of the photosensitive layer support base according to the present embodiment is not particularly limited and photosensitive layer support bases with diameters within a wide range may be used as appropriate, for example, the diameter favorably ranges from 20 mm to 40 mm from the perspectives of reducing size and weight of a photosensitive drum.

[Photosensitive Layer]

The photosensitive layer included in the positively-charged single-layer electrophotographic photoreceptor according to the present embodiment can be used as a photosensitive layer of a positively-charged single-layer electrophotographic photoreceptor. Any photosensitive layer can be used as long as the photosensitive layer is constituted by at least a charge generating material, a charge transporting material, and a binding resin. In this case, a charge transporting material refers to a hole transporting material (HTM) and/or an electron transporting material (ETM).

The photosensitive layer is a single-layer photosensitive layer in which a charge transporting material is dispersed together with a charge generating material in a same photosensitive layer.

A single-layer photosensitive layer is formed by coating, using coating means or the like, a conductive substrate with an application liquid produced by dissolving or dispersing a charge generating material, a charge transporting material, and a binding resin in a suitable organic solvent and drying the application liquid. Such a single-layer photosensitive layer is advantageous in that the photosensitive layer has a simple layer construction and high productivity, coating defects in the photosensitive layer can be suppressed, optical characteristics can be improved due to a smaller interface area between layers, electron transportation performance can be improved and a photoreceptor with higher sensitivity can be obtained since the photosensitive layer contains both an electron transporting material and electron acceptors.

The photosensitive layer is formed by coating the photosensitive layer support base with a photosensitive layer-forming application liquid in which the respective components described above are dissolved or dispersed according to a known method in an order corresponding to a desired layer construction and by drying the photosensitive layer-forming application liquid.

(Binding Resin)

The binding resin is not particularly limited as long as the binding resin can be used as a binding resin that is contained in a photosensitive layer of a positively-charged single-layer electrophotographic photoreceptor. Specific examples of resins that can be preferably used as the binding resin include: thermoplastic resins such as polycarbonate resins, styrene-based resins, styrene-butadiene copolymers, styrene-acrylonitrile copolymers, styrene-maleic acid copolymers, styrene-acrylic acid copolymers, acrylic copolymers, polyethylene resins, ethylene-vinyl acetate copolymers, chlorinated polyethylene resins, polyvinylchloride resins, polypropylene resins, ionomers, vinyl chloride-vinyl acetate copolymers, polyester resins, alkyd resins, polyamide resins, polyurethane resins, polyarylate resins, polysulfone resins, diallyl phthalate resins, ketone resins, polyvinyl butyral resins, and polyether resins; thermosetting resins such as silicone resins, epoxy resins, phenol resins, urea resins, melamine resins, and other crosslinkable thermosetting resins; and photocurable resins such as epoxy acrylate resins and urethane-acrylate copolymer resins. These resins may be used alone or two or more resins may be used in combination.

Among these resins, since a photosensitive layer with excellent balance among processability, mechanical characteristics, optical characteristics, and abrasion resistance can be obtained, polycarbonate resins such as a bisphenol Z polycarbonate resin, a bisphenol ZC polycarbonate resin, a bisphenol C polycarbonate resin, a bisphenol A polycarbonate resin, and copolymer polycarbonates and polyarylate resins having these resins as skeletons are more favorable.

(Charge Generating Material)

The charge generating material (CGM) is not particularly limited as long as the charge generating material can be used as a charge generating material of a positively-charged single-layer electrophotographic photoreceptor. Specific examples include powders of inorganic photoconducting materials such as x-type metal-free phthalocyanine (x-H2Pc) represented by chemical formula (I) below, y-type oxotitanyl phthalocyanine (y-TiOPc), perylene pigments, bisazo pigments, dithioketo pyrrolopyrrole pigments, metal-free naphthalocyanine pigments, metal naphthalocyanine pigments, squaraine pigments, trisazo pigments, indigo pigments, azulenium pigments, cyanine pigments, selenide, selenide-tellurium, selenide-arsenic, cadmium sulfide, and amorphous silicon, pyrylium salts, anthanthrone-based pigments, triphenylmethane-based pigments, indanthrene-based pigments, toluidine-based pigments, pyrazoline-based resins, and quinacridone-based pigments.

[Chemical formula 1]

Formula (1)

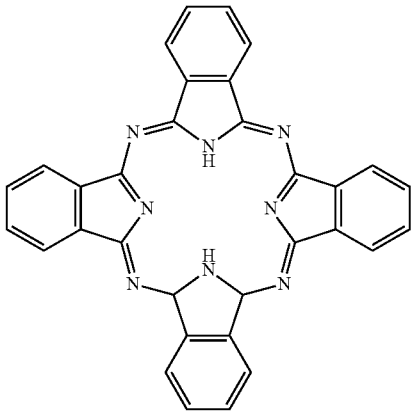

In addition, a charge generating material may be used alone or a two or more charge generating materials may be used in combination so as to have an absorption wavelength in a desired region. Furthermore, since an image forming apparatus of a digital optical system such as a laser beam printer or a facsimile which uses a light source such as a semiconductor laser particularly requires a photoreceptor having sensitivity in a wavelength range of 700 nm or longer, for example, phthalocyanine-based pigments such as metal-free phthalocyanine and oxotitanyl phthalocyanine are preferably used among the charge generating materials listed above. Moreover, a crystalline form of the phthalocyanine-based pigments is not particularly limited and phthalocyanine-based pigments with various crystalline forms may be used. In addition, since an image forming apparatus of an analog optical system such as a static copier that uses a white light source such as a halogen lamp requires a photoreceptor having sensitivity in the visible range, for example, perylene pigments or bisazo pigments are preferably used.

(Hole Transporting Material)

The hole transporting material (HTM) is not particularly limited as long as the hole transporting material can be used as a hole transporting material that is contained in a photosensitive layer of a positively-charged single-layer electrophotographic photoreceptor. Specific examples of the hole transporting material include benzidine derivatives, oxadiazole-based compounds such as 2,5-di(4-methylaminophenyl)-1,3,4-oxadiazole, styryl-based compounds such as 9-(4-diethylaminostyryl)anthracene, carbazole-based compounds such as polyvinyl carbazole, organic polysilane compounds, pyrazoline-based compounds such as 1-phenyl-3-(p-dimethylaminophenyl)pyrazoline, nitrogen-containing cyclic compounds such as hydrazone-based compounds, triphenylamine-based compounds, indole-based compounds, oxadiazole-based compounds, isoxazole-based compounds, triazole-based compounds and triazole-based compounds, and condensed polycyclic compounds. Among these hole transporting materials, triphenylamine-based compounds having one or a plurality of triphenylamine skeletons per molecule are more favorable. These hole transporting materials may be used alone or two or more hole transporting materials may be used in combination.

(Electron Transporting Material)

The electron transporting material (ETM) is not particularly limited as long as the electron transporting material can be used as an electron transporting material that is contained in a photosensitive layer of a positively-charged single-layer electrophotographic photoreceptor. Specific examples include quinone derivatives such as naphthoquinone derivatives, diphenoquinone derivatives, anthraquinone derivatives, azoquinone derivatives, nitroanthraquinone derivatives, and dinitroanthraquinone derivatives, malononitrile derivatives, thiopyran derivatives, trinitrothioxanthone derivatives, 3,4,5,7-tetranitro-9-fluorenone derivatives, dinitroanthracene derivatives, dinitroacridine derivatives, tetracyanoethylene, 2,4,8-trinitrothioxanthone, dinitrobenzene, dinitroanthracene, dinitroacridine, succinic anhydride, maleic anhydride, and dibromo maleic anhydride. These electron transporting materials may be used alone or two or more electron transporting materials may be used in combination.

(Additives)

Besides the charge generating material, the hole transporting material, the electron transporting material, and the binding resin, the photosensitive layer of the positively-charged single-layer electrophotographic photoreceptor may contain various additives as long as electrophotographic characteristics are not adversely affected. Examples of additives that can be added into the photosensitive layer include deterioration preventing agents such as an antioxidant, a radical scavenger, a singlet quencher, and an ultraviolet absorber, a softener, a plasticizer, polyaromatic compounds, a surface modifier, an extender, a thickener, a dispersion stabilizer, a wax, an oil, an acceptor, a donor, a surfactant, and a leveling agent.

[Intermediate Layer]

Moreover, while an intermediate layer is not an essential component of the present disclosure, when the intermediate layer 14 is provided between the photosensitive layer support base 11 and the photosensitive layer 21 as shown in FIG. 1B, the intermediate layer can prevent a charge on the side of a conductive substrate 11 from being introduced into the photosensitive layer, increase bonding strength of the photosensitive layer 21 onto the conductive substrate 11, and coat and smooth defects on a surface of the conductive substrate 11.

(Method of Manufacturing Positively-Charged Single-Layer Electrophotographic Photoreceptor)

The method of manufacturing the positively-charged single-layer electrophotographic photoreceptor is not particularly limited as long as the object of the present disclosure is not inhibited. Preferable examples of methods of manufacturing the positively-charged single-layer electrophotographic photoreceptor include a method of coating a photosensitive layer support base with a photosensitive layer application liquid and forming a photosensitive layer. Specifically, the positively-charged single-layer electrophotographic photoreceptor can be manufactured by coating a photosensitive layer support base with an application liquid produced by dissolving or dispersing a charge generating material, a charge transporting material, a binding resin and, as necessary, various additives and the like in a solvent and drying the application liquid. Application methods are not particularly limited and examples thereof include methods using a spin coater, an applicator, a spray coater, a bar coater, a dip coater, or a doctor blade. Among these application methods, an immersion-removal method using a dip coater enables continuous production and achieves economic efficiency and is therefore favorable. As described earlier, blushing is particularly likely to occur at an end when manufacturing a positively-charged single-layer electrophotographic photoreceptor by the immersion-removal method. However, by using a support base shaped as described earlier, the occurrence of blushing at the end can be prevented even when using the immersion-removal method. In addition, methods of drying a coating film that is formed on the photosensitive layer support base include performing hot air drying at 80 to 150° C. for 15 to 120 minutes.

In the positively-charged single-layer electrophotographic photoreceptor, respective contents of the charge generating material, the hole transporting material, the electron transporting material, and the binding resin are selected as appropriate and are not particularly limited. Specifically, for example, in the case of a single-layer photosensitive layer, the content of the charge generating material is favorably 0.1 parts by mass or more and 50 parts by mass or less and more favorably 0.5 parts by mass or more and 30 parts by mass or less with respect to 100 parts by mass of the binding resin. The content of the electron transporting material is favorably 5 parts by mass or more and 100 parts by mass or less and more favorably 10 parts by mass or more and 80 parts by mass or less with respect to 100 parts by mass of the binding resin. The content of the hole transporting material is favorably 5 parts by mass or more and 500 parts by mass or less and more favorably 25 parts by mass or more and 200 parts by mass or less with respect to 100 parts by mass of the binding resin. In addition, a sum total of the hole transporting material and the electron transporting material or, in other words, the content of the charge transporting material is favorably 20 parts by mass or more and 500 parts by mass or less and more favorably 30 parts by mass or more and 200 parts by mass or less with respect to 100 parts by mass of the binding resin.

The solvent contained in the photosensitive layer application liquid is not particularly limited as long as the solvent can dissolve or disperse the respective components that make up the photosensitive layer. Specific examples include: alcohols such as methanol, ethanol, isopropanol, and butanol; aliphatic hydrocarbons such as n-hexane, octane, and cyclohexane; aromatic hydrocarbons such as benzene, toluene, and xylene; halogenated hydrocarbons such as dichloromethane, dichloroethane, carbon tetrachloride, and chlorobenzene; ethers such as dimethyl ether, diethyl ether, tetrahydrofuran, ethylene glycol dimethyl ether, and diethylene glycol dimethyl ether; ketones such as acetone, methyl ethyl ketone, methyl isobutyl ketone, and cyclohexanone; esters such as ethyl acetate and methyl acetate; and aprotic polar organic solvents such as dimethyl formaldehyde, dimethyl formamide, and dimethyl sulfoxide. These solvents may be used alone or two or more solvents may be used in combination.

A thickness of the photosensitive layer of the positively-charged single-layer electrophotographic photoreceptor is not particularly limited as long as sufficient action as a photosensitive layer can be produced. Specifically, for example, the thickness of the photosensitive layer is favorably 5 μm or more and 100 μm or less and more favorably 10 μm or more and 50 μm or less.

Second Embodiment

A second embodiment of the present disclosure relates to an image forming apparatus comprising an image carrier, a contact-charging charging member which applies a direct current voltage for charging a surface of the image carrier, an exposure member which exposes the charged surface of the image carrier to form an electrostatic latent image on the surface of the image carrier, a developing member which develops the electrostatic latent image as a toner image, and a transfer member which transfers the toner image from the image carrier to a transfer-receiving body, wherein the positively-charged single-layer electrophotographic photoreceptor according to the first embodiment is used as the image carrier.

As the image forming apparatus according to the present embodiment, known image forming apparatuses can be adopted without particular limitations. Although a tandem-type color image forming apparatus that uses toners of a plurality of colors is favorable among known image forming apparatuses, the present embodiment is not limited thereto. More specifically, a tandem-type color image forming apparatus that uses toners of a plurality of colors as described below may be used.

In order to form a toner image by a toner of each different color on each surface, the image forming apparatus comprising the positively-charged single-layer electrophotographic photoreceptor according to the present embodiment comprises a plurality of image carriers juxtaposed in a predetermined direction and a plurality of developing sections which are arranged so as to oppose each image carrier and which have developing rollers that carry and transport toner on a surface thereof and respectively supply the transported toner to a surface of each image carrier, wherein the positively-charged single-layer electrophotographic photoreceptor is respectively used as each of the image carriers.

Figure 2:
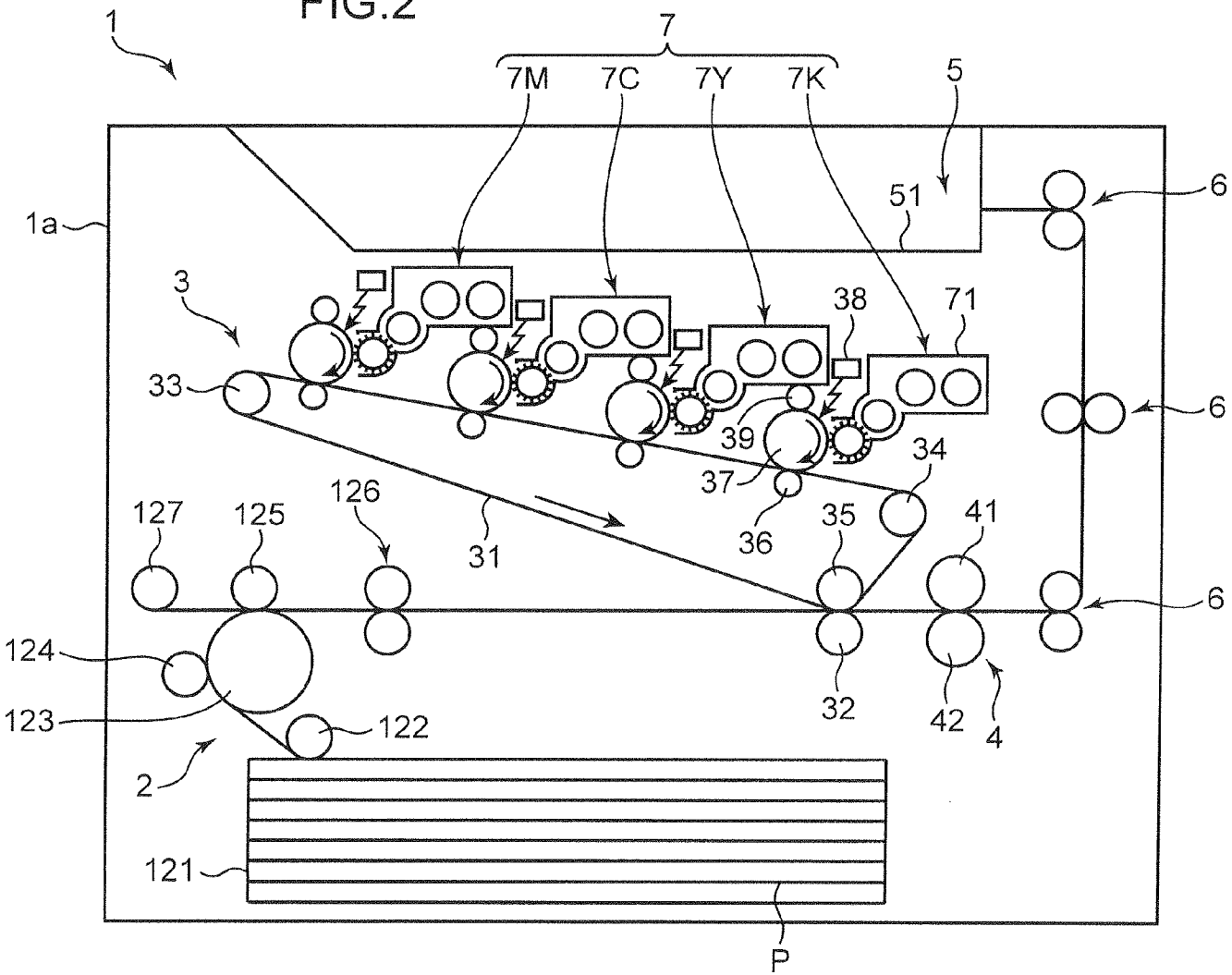
FIG. 2 is a schematic diagram showing a configuration of an image forming apparatus comprising a positively-charged single-layer electrophotographic photoreceptor according to a second embodiment of the present disclosure.

FIG. 2 is a schematic diagram showing a configuration of an image forming apparatus comprising a positively-charged single-layer electrophotographic photoreceptor according to the present embodiment. The image forming apparatus will now be describing using a color printer 1 as an example.

As shown in FIG. 2, the color printer 1 includes a box-like apparatus main body 1*a*. Provided inside the apparatus main body 1*a* are a paper feeding member 2 which feeds a sheet of paper P, an image forming member 3 which transfers a toner image based on image data or the like on the sheet of paper P that is fed from the paper feeding member 2 while transporting the sheet of paper P, and a fixing member 4 which fixes, on the sheet of paper P, an unfixed toner image transferred on the sheet of paper P by the image forming member 3. Furthermore, a paper discharge member 5 which discharges the sheet of paper P subjected to a fixing process by the fixing member 4 is provided on an upper surface of the apparatus main body 1*a*.

The paper feeding member 2 comprises a paper cassette 121, a pickup roller 122, paper feeding rollers 123, 124, and 125, and a resist roller 126. The paper cassette 121 is provided so as to be insertable to and removable from the apparatus main body 1*a* and stores sheets of paper P of respective sizes. The pickup roller 122 is provided at a position to the left and above the paper cassette 121 as shown in FIG. 2, and ejects the sheets of paper P stored in the paper cassette 121 one sheet at a time. The paper feeding rollers 123, 124, and 125 send the sheet of paper P ejected by the pickup roller 122 to a paper conveying path. The resist roller 126 temporarily places the sheet of paper P sent to the paper conveying path by the paper feeding rollers 123, 124, and 125 on standby and supplies the sheet of paper P to the image forming member 3 at a predetermined timing.

The paper feeding member 2 further comprises a manual feed tray (not shown) to be mounted to a left side surface of the apparatus main body 1*a* shown in FIG. 2 and a pickup roller 127. The pickup roller 127 ejects a sheet of paper P placed in the manual feed tray. The sheet of paper P ejected by the pickup roller 127 is sent to the paper conveying path by the paper feeding rollers 123, 124, and 125 and supplied by the resist roller 126 to the image forming member 3 at a predetermined timing.

The image forming member 3 comprises an image forming unit 7, an intermediate transfer belt 31 with a surface (a contact surface) on which a toner image based on image data transmitted from a computer or the like is primary-transferred by the image forming unit 7, and a secondary transfer roller 32 which performs secondary transfer of the toner image on the intermediate transfer belt 31 to the sheet of paper P sent from the paper cassette 121.

The image forming unit 7 comprises a black unit 7K, a yellow unit 7Y, a cyan unit 7C, and a magenta unit 7M which are sequentially arranged from an upstream side (a right side in FIG. 2) to a downstream side. In each of the units 7K, 7Y, 7C, and 7M, a positively-charged single-layer electrophotographic photoreceptor 37 (hereinafter, referred to as a photoreceptor 37) as an image carrier is arranged at a center position so as to be rotatable in a direction depicted by an arrow (clockwise). In addition, a charging member 39, an exposure member 38, a developing member 71, a cleaning member (not shown), a static eliminator (not shown) as a static eliminating member, and the like are respectively arranged around each photoreceptor 37 in sequence from an upstream side in the direction of rotation. Moreover, the positively-charged single-layer electrophotographic photoreceptor according to the first embodiment is used as the photoreceptor 37.

The charging member 39 uniformly charges a circumferential surface of the electrophotographic photoreceptor 37 that is being rotated in the direction of the arrow. The charging member 39 is not particularly limited as long as the circumferential surface of the electrophotographic photoreceptor 37 can be uniformly charged and may adopt a non-contact system or a contact system. Specific examples of the charging member 39 include a corona charging apparatus, a charging roller, and a charging brush. A contact charging apparatus such as a charging roller or a charging brush is more favorable. The use of a contact charging member 39 suppresses discharge of active gases such as ozone or nitrogen oxides generated by the charging member 39, enables degradation of the photosensitive layer of the electrophotographic photoreceptor due to active gas to be prevented, and enables design which takes office environment and the like into consideration to be adopted.

The charging member 39 comprising the contact charging roller charges the circumferential surface (surface) of the photoreceptor 37 while keeping the charging roller in contact with the photoreceptor 37. Examples of such a charging roller include a charging roller which rotates along with a rotation of the photoreceptor 37 while remaining in contact with the photoreceptor 37. In addition, examples of such a charging roller include a roller in which at least a surface portion thereof is made of resin. More specifically, examples of such a charging roller include a charging roller comprising a rotatably supported metal core, a resin layer formed on the metal core, and a voltage applying member which applies voltage to the metal core. With the charging member comprising such a charging roller, by applying voltage to the metal core from the voltage applying member, a surface of the photoreceptor 37 which is in contact via the resin layer can be charged.

Favorably, the voltage applied to the charging roller by the voltage applying member is solely a direct current voltage. The direct current voltage that is applied to the electrophotographic photoreceptor by the charging roller is favorably 1000 V to 2000 V, more favorably 1200 V to 1800 V, and particularly favorably 1400 V to 1600V. Compared to cases where an alternating current voltage or a superposed voltage created by superposing an alternating current voltage on a direct current voltage is applied to the charging roller, applying only a direct current voltage to the charging roller tends to reduce the amount of wear of the photosensitive layer.

In addition, the resin that constitutes the resin layer of the charging roller is not particularly limited as long as the circumferential surface of the photoreceptor 37 can be preferably charged. Specific examples of the resin used in the resin layer include silicone resins, urethane resins, and modified silicone resins. Furthermore, the resin layer may contain an inorganic filler.

The exposure member 38 is a so-called laser scanning unit which irradiates laser light based on image data inputted from a personal computer (PC) that is an upper-level apparatus on the circumferential surface of the photoreceptor 37 that is uniformly charged by the charging member 39 to form an electrostatic latent image based on the image data on the photoreceptor 37. The developing member 71 supplies toner to the circumferential surface of the photoreceptor 37 on which the electrostatic latent image is formed in order to form a toner image based on the image data. The toner image is then primary-transferred to the intermediate transfer belt 31. After the primary transfer of the toner image to the intermediate transfer belt 31 is finished, the cleaning member cleans the toner remaining on the circumferential surface of the photoreceptor 37. The static eliminator eliminates static from the circumferential surface of the photoreceptor 37 after the primary transfer is finished. After being subjected to the cleaning process by the cleaning member and the static eliminator, the circumferential surface of the photoreceptor 37 proceeds toward the charging member 39 for a new cleaning process and is subjected to the new cleaning process.

The intermediate transfer belt 31 is an endless belt-like rotating body which is suspended across a plurality of rollers including a driving roller 33, a driven roller 34, a backup roller 35, and a primary transfer roller 36 so that a surface (contact surface) side of the intermediate transfer belt 31 abuts circumferential surfaces of the respective photoreceptors 37. In addition, the intermediate transfer belt 31 is configured so as to be endlessly rotated by the plurality of rollers in a state where the intermediate transfer belt 31 is pushed against the respective photoreceptors 37 by the primary transfer roller 36 that is arranged so as to oppose the photoreceptors 37. The driving roller 33 is rotationally driven by a drive source such as a stepping motor and imparts a drive force for endlessly rotating the intermediate transfer belt 31. The driven roller 34, the backup roller 35, and the primary transfer roller 36 are rotatably provided and are driven so as to rotate along with the endless rotation of the intermediate transfer belt 31 due to the driving roller 33. The rollers 34, 35, and 36 are driven so as to rotate via the intermediate transfer belt 31 in accordance with a main driving rotation of the driving roller 33 and support base the intermediate transfer belt 31.

The primary transfer roller 36 applies a primary transfer bias (with a reverse polarity to a charging polarity of the toners) to the intermediate transfer belt 31. Accordingly, the toner images formed on the respective photoreceptors 37 are sequentially transferred (primary-transferred) in a multi-coated state on the intermediate transfer belt 31 which revolves in a direction of an arrow (counter-clockwise) due to the driving of the driving roller 33 between the respective photoreceptors 37 and the primary transfer roller 36.

The secondary transfer roller 32 applies a secondary transfer bias with a reverse polarity to the toner images to the sheet of paper P. Accordingly, the toner images primary-transferred on the intermediate transfer belt 31 are transferred to the sheet of paper P between the secondary transfer roller 32 and the backup roller 35. As a result, a color transfer image (an unfixed toner image) is transferred to the sheet of paper P.

The fixing member 4 performs a fixing process on a transfer image that has been transferred to the sheet of paper P at the image forming member 3 and comprises a heating roller 41 which is heated by a conductive heat generator and a pressure roller 42 which is arranged so as to oppose the heating roller 41 and whose circumferential surface is pushed so as to abut a circumferential surface of the heating roller 41.

The transfer image that has been transferred to the sheet of paper P by the secondary transfer roller 32 at the image forming member 3 is fixed to the sheet of paper P by a fixing process due to heating when the sheet of paper P passes between the heating roller 41 and the pressure roller 42. Subsequently, the sheet of paper P subjected to the fixing process is discharged to the paper discharge member 5. In addition, with the color printer 1 according to the present embodiment, a conveying roller 6 is arranged at an appropriate location between the fixing member 4 and the paper discharge member 5.

The paper discharge member 5 is formed by depressing a summit of the apparatus main body 1*a* of the color printer 1, and a paper discharge tray 51 which accepts the discharged sheet of paper P is formed in a bottom portion of the formed recess.

The color printer 1 performs image formation on the sheet of paper P according to an image forming operation such as that described above. In addition, since a tandem-type image forming apparatus such as that described above comprises the positively-charged single-layer electrophotographic photoreceptor according to the first embodiment as an image carrier, an image forming apparatus capable of preventing an abrupt decline in charge potential in an initial stage of use of the positively-charged single-layer electrophotographic photoreceptor and capable of forming preferable images can be obtained even under conditions where a contact charging system of applying a direct current voltage that may not necessarily provide preferable charging efficiency is used as a charging system and a charge potential on a surface of the positively-charged single-layer electrophotographic photoreceptor cannot be readily stabilized.

EXAMPLES

Hereinafter, the present disclosure will be described in greater detail by way of examples. It is to be understood that the examples do not limit the present disclosure in any way.

(Processing of Aluminum Tubular Photosensitive Layer Support Base)

Aluminum tubular photosensitive layer support bases with a diameter of 30 mm, a length of 250 mm, and various wall thicknesses shown in Table 1 were prepared by processing end surfaces thereof with a cutting tool so as to satisfy the requirements of a, b, and c shown in FIG. 1.

(Preparation of Photosensitive Layer Application Liquid)

100 parts by mass of a bisphenol Z polycarbonate resin as a binding resin, 3 parts by mass of metal-free phthalocyanine as a charge generating material, 70 parts by mass of N, N-diethyl amino benzaldehyde diphenyl hydrazone as a hole transporting material, 40 parts by mass of 4,4'-tert-amyl-1,1'-bisnaphthyl-4,4'-quinone as an electron transporting material, and 0.1 parts by mass of a leveling agent (KF-96-50CS manufactured by Shin-Etsu Chemical Co., Ltd.) were added and dissolved into 420 parts by mass of tetrahydrofuran as an organic solvent. The solution was then dispersed for 20 minutes by a dispersion mill to prepare a photosensitive layer application liquid.

(Fabrication of Photoreceptor)

Surface-cleaned cylindrical aluminum tubes fabricated under the above conditions were coated by the application liquid using an immersion-removal method so that the photosensitive layer had a film thickness of 35 μm after drying. Coating was performed in a 23° C., 50% RH environment. The aluminum tubes coated with the application liquid were placed in room temperature for 5 minutes and then subjected to heat treatment at 100° C. for 30 minutes to obtain positively-charged single-layer electrophotographic photoreceptors.

(Evaluation)

<Occurrence of Blushing>

A 0 to 30 mm-lower end photosensitive layer region after drying was visually observed and judged regarding whether or not a blushing (whitening) phenomenon had occurred due to adhesion of dew condensation on the surface. Cases where blushing had been observed were judged as "Good" and cases where blushing had not been observed were judged as "Poor".

<Tubular Photosensitive Layer Support Base End Surface Strength>

Figure 3:
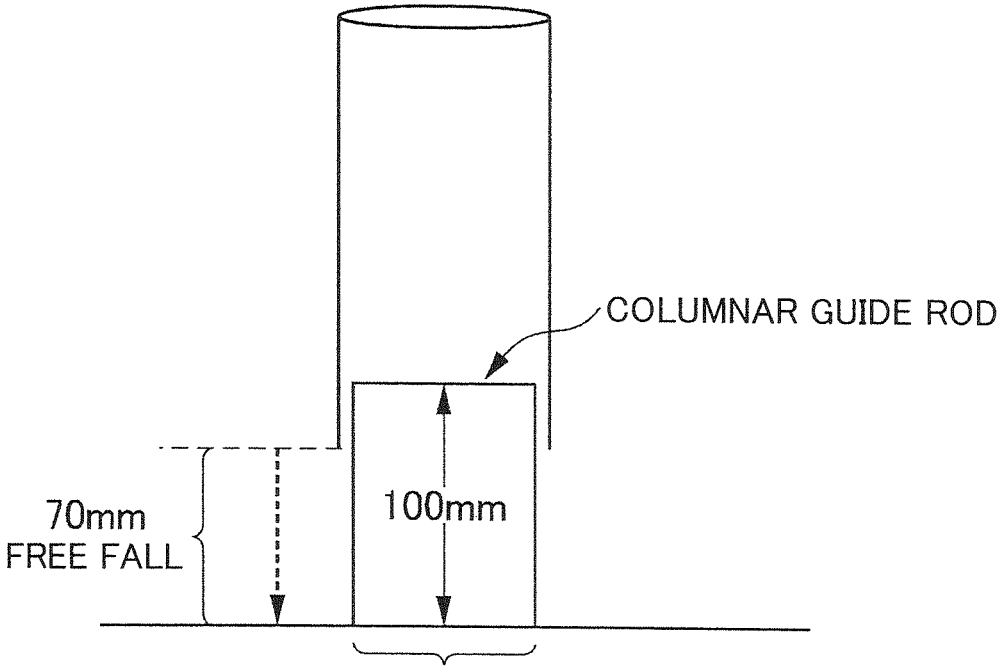
FIG. 3 is a diagram showing an evaluation method of end surface strength of the tubular photosensitive layer support bases which were used in examples and comparative examples.

Using a columnar guide rod such as that shown in FIG. 3, the tubular photosensitive layer support bases were allowed to fall freely 10 times from a height of 70 mm. Subsequently, whether or not a deformation such as a collapse had occurred on the lower end surfaces of the tubular photosensitive layer support bases was visually judged. Cases where a deformation had been observed on the lower end surface of a tubular photosensitive layer support base were judged as "Poor" and cases where deformation had not been observed on the lower end surface of a tubular photosensitive layer support base were judged as "Good".

TABLE 1

| Example | Wall thickness (mm) | a (°) | b (mm) | c (mm) | Blushing | End surface deformation |
|---|---|---|---|---|---|---|
| 1 | 0.70 | 30 | 0.10 | 0.30 | Good | Good |
| 2 | 0.70 | 30 | 0.20 | 0.25 | Good | Good |
| 3 | 0.70 | 30 | 0.20 | 0.30 | Good | Good |
| 4 | 0.70 | 30 | 0.20 | 0.35 | Good | Good |
| 5 | 0.70 | 30 | 0.25 | 0.30 | Good | Good |
| 6 | 0.70 | 30 | 0.30 | 0.30 | Good | Good |
| 7 | 0.70 | 30 | 0.40 | 0.30 | Good | Good |
| 8 | 0.70 | 40 | 0.15 | 0.20 | Good | Good |
| 9 | 0.70 | 40 | 0.15 | 0.30 | Good | Good |
| 10 | 0.70 | 40 | 0.25 | 0.35 | Good | Good |
| 11 | 0.70 | 40 | 0.30 | 0.40 | Good | Good |
| 12 | 0.70 | 50 | 0.05 | 0.30 | Good | Good |
| 13 | 0.70 | 50 | 0.15 | 0.30 | Good | Good |
| 14 | 0.70 | 50 | 0.25 | 0.35 | Good | Good |
| 15 | 0.70 | 50 | 0.30 | 0.40 | Good | Good |
| 16 | 0.70 | 60 | 0.10 | 0.30 | Good | Good |
| 17 | 0.70 | 60 | 0.20 | 0.30 | Good | Good |
| 18 | 0.70 | 60 | 0.20 | 0.35 | Good | Good |
| 19 | 0.70 | 60 | 0.25 | 0.30 | Good | Good |
| 20 | 0.70 | 60 | 0.30 | 0.30 | Good | Good |
| 21 | 0.70 | 60 | 0.40 | 0.30 | Good | Good |
| 22 | 0.60 | 30 | 0.10 | 0.30 | Good | Good |
| 23 | 0.60 | 30 | 0.20 | 0.25 | Good | Good |
| 24 | 0.60 | 30 | 0.20 | 0.30 | Good | Good |
| 25 | 0.60 | 30 | 0.25 | 0.30 | Good | Good |
| 26 | 0.60 | 30 | 0.30 | 0.30 | Good | Good |
| 27 | 0.60 | 30 | 0.40 | 0.20 | Good | Good |
| 28 | 0.60 | 40 | 0.15 | 0.30 | Good | Good |
| 29 | 0.60 | 40 | 0.30 | 0.30 | Good | Good |

TABLE 2

| Example | Wall thickness (mm) | a (°) | b (mm) | c (mm) | Blushing | End surface deformation |
|---|---|---|---|---|---|---|
| 30 | 0.60 | 50 | 0.05 | 0.30 | Good | Good |
| 31 | 0.60 | 50 | 0.15 | 0.30 | Good | Good |
| 32 | 0.60 | 60 | 0.10 | 0.30 | Good | Good |
| 33 | 0.60 | 60 | 0.20 | 0.30 | Good | Good |
| 34 | 0.60 | 60 | 0.25 | 0.30 | Good | Good |
| 35 | 0.60 | 60 | 0.30 | 0.30 | Good | Good |
| 36 | 0.55 | 30 | 0.10 | 0.30 | Good | Good |
| 37 | 0.55 | 30 | 0.20 | 0.30 | Good | Good |
| 38 | 0.55 | 30 | 0.25 | 0.30 | Good | Good |
| 39 | 0.55 | 40 | 0.15 | 0.30 | Good | Good |
| 40 | 0.55 | 50 | 0.05 | 0.30 | Good | Good |
| 41 | 0.55 | 50 | 0.15 | 0.30 | Good | Good |
| 42 | 0.55 | 60 | 0.10 | 0.30 | Good | Good |
| 43 | 0.55 | 60 | 0.20 | 0.30 | Good | Good |
| 44 | 0.55 | 60 | 0.25 | 0.30 | Good | Good |
| 45 | 0.50 | 30 | 0.10 | 0.30 | Good | Good |
| 46 | 0.50 | 30 | 0.20 | 0.30 | Good | Good |
| 47 | 0.50 | 40 | 0.15 | 0.30 | Good | Good |
| 48 | 0.50 | 50 | 0.05 | 0.30 | Good | Good |
| 49 | 0.50 | 50 | 0.15 | 0.30 | Good | Good |
| 50 | 0.50 | 60 | 0.10 | 0.30 | Good | Good |
| 51 | 0.50 | 60 | 0.20 | 0.30 | Good | Good |
| 52 | 0.40 | 30 | 0.10 | 0.30 | Good | Good |
| 53 | 0.40 | 50 | 0.05 | 0.30 | Good | Good |
| 54 | 0.40 | 60 | 0.10 | 0.30 | Good | Good |

TABLE 3

| | Wall thickness (mm) | a (°) | b (mm) | c (mm) | Blushing | End surface deformation |
|---|---|---|---|---|---|---|
| Comparative example 1 | 0.70 | 20 | 0.10 | 0.50 | Poor | Good |
| Comparative example 2 | 0.70 | 20 | 0.20 | 0.20 | Poor | Poor |
| Comparative example 3 | 0.70 | 20 | 0.20 | 0.30 | Poor | Good |
| Comparative example 4 | 0.70 | 25 | 0.10 | 0.50 | Poor | Good |
| Comparative example 5 | 0.70 | 25 | 0.20 | 0.20 | Poor | Poor |
| Comparative example 6 | 0.70 | 25 | 0.20 | 0.30 | Poor | Good |
| Example 55 | 0.70 | 30 | 0.10 | 0.25 | Good | Poor |
| Comparative example 7 | 0.70 | 50 | 0.03 | 0.30 | Poor | Poor |
| Example 56 | 0.70 | 50 | 0.05 | 0.25 | Good | Poor |
| Example 57 | 0.70 | 60 | 0.10 | 0.25 | Good | Poor |
| Example 58 | 0.70 | 60 | 0.20 | 0.25 | Good | Poor |
| Comparative example 8 | 0.70 | 65 | 0.05 | 0.25 | Poor | Poor |
| Comparative example 9 | 0.70 | 65 | 0.10 | 0.30 | Poor | Good |
| Comparative example 10 | 0.70 | 65 | 0.20 | 0.35 | Poor | Good |
| Comparative example 11 | 0.60 | 20 | 0.10 | 0.50 | Poor | Good |
| Comparative example 12 | 0.60 | 20 | 0.20 | 0.20 | Poor | Poor |
| Comparative example 13 | 0.60 | 20 | 0.20 | 0.30 | Poor | Good |
| Comparative example 14 | 0.60 | 25 | 0.20 | 0.30 | Poor | Good |
| Example 59 | 0.60 | 30 | 0.10 | 0.25 | Good | Poor |
| Example 60 | 0.60 | 40 | 0.15 | 0.20 | Good | Poor |

TABLE 4

| | Wall thickness (mm) | a (°) | b (mm) | c (mm) | Blushing | End surface deformation |
|---|---|---|---|---|---|---|
| Comparative example 15 | 0.60 | 50 | 0.03 | 0.25 | Poor | Poor |
| Example 61 | 0.60 | 50 | 0.10 | 0.20 | Good | Poor |
| Example 62 | 0.60 | 60 | 0.20 | 0.25 | Good | Poor |
| Comparative example 16 | 0.60 | 65 | 0.05 | 0.25 | Poor | Poor |
| Comparative example 17 | 0.60 | 65 | 0.20 | 0.35 | Poor | Good |
| Comparative example 18 | 0.55 | 25 | 0.20 | 0.20 | Poor | Poor |
| Example 63 | 0.55 | 30 | 0.10 | 0.25 | Good | Poor |
| Example 64 | 0.55 | 30 | 0.20 | 0.25 | Good | Poor |
| Comparative example 19 | 0.55 | 50 | 0.03 | 0.25 | Poor | Poor |
| Example 65 | 0.55 | 50 | 0.05 | 0.25 | Good | Poor |
| Example 66 | 0.55 | 60 | 0.15 | 0.25 | Good | Poor |
| Example 67 | 0.55 | 60 | 0.20 | 0.25 | Good | Poor |
| Comparative example 20 | 0.55 | 65 | 0.05 | 0.25 | Poor | Poor |
| Comparative example 21 | 0.55 | 65 | 0.20 | 0.35 | Poor | Good |
| Comparative example 22 | 0.50 | 25 | 0.20 | 0.20 | Poor | Poor |
| Example 68 | 0.50 | 30 | 0.20 | 0.25 | Good | Poor |
| Example 69 | 0.50 | 40 | 0.15 | 0.20 | Good | Poor |
| Example 70 | 0.50 | 50 | 0.10 | 0.20 | Good | Poor |
| Example 71 | 0.50 | 60 | 0.15 | 0.25 | Good | Poor |
| Example 72 | 0.50 | 60 | 0.20 | 0.25 | Good | Poor |
| Comparative example 23 | 0.50 | 70 | 0.10 | 0.25 | Poor | Poor |
| Comparative example 24 | 0.40 | 30 | 0.10 | 0.25 | Good | Poor |

As shown in Tables 1 to 4, it was confirmed that blushing does not occur when the end shape of a tubular photosensitive layer support base satisfies the conditions of the present disclosure. In addition, it was found that mechanical strength is obtained and no deformation occurs even when a shock is applied to the end surface of a tubular photosensitive layer support base when the bottom surface length (c) of the end surface of the tubular photosensitive layer support base is 0.3 mm or more.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A positively-charged single-layer electrophotographic photoreceptor, comprising:

a tubular photosensitive layer support base having opposite inner and outer circumferential surfaces defining a wall thickness (t) that is 0.7 mm or less, an axial end surface at one end of the tubular photosensitive support base, and inner and outer chamfers extending between the respective inner and outer circumferential surfaces and the axial end surface the outer chamfer being aligned at an outer chamfer angle (a) of an end surface of the photosensitive layer support base that is 40° or more and 60° or less with respect to a longitudinal tangent of the outer circumferential surface of the tubular photosensitive layer support base, an end of the outer chamfer at the axial end surface being offset radially from the outer circumferential surface by an outer end surface-tail edge surface width (b) that is 0.05 mm or more, and an end of the inner chamfer at the axial end surface being offset radially from the inner circumferential surface by an inner end surface-tail edge surface width that is 0.10 mm or more, wherein the inner end surface-tail edge surface width is the difference of the wall thickness and the sum of the outer end surface-tail edge surface width (b) and a bottom surface length (c).

2. The positively-charged single-layer electrophotographic photoreceptor according to claim 1, wherein the bottom surface length (c) is 0.3 mm or more.

3. The positively-charged single-layer electrophotographic photoreceptor according to claim 1, wherein the outer end surface-tail edge surface width (b) is 0.40 mm or less.

4. An image forming apparatus comprising: an image carrier; a charging member which charges a surface of the image carrier; an exposure member which exposes the charged surface of the image carrier to form an electrostatic latent image on the surface of the image carrier; a developing member which develops the electrostatic latent image as a toner image, and a transfer member which transfers the toner image from the image carrier to a material to be transferred, wherein the image carrier is the electrophotographic photoreceptor according to claim 1.

5. The positively-charged single-layer electrophotographic photoreceptor according to claim 1, wherein the wall thickness is 0.4 mm or more.

6. The positively-charged single-layer electrophotographic photoreceptor according to claim 1, wherein an inner side of the end surface is chamfered.

* * * * *